United States Patent [19]

Zeleny

[11] Patent Number: 4,775,277

[45] Date of Patent: Oct. 4, 1988

[54] MANUFACTURING SYSTEM FOR THE AUTOMATIC PROCESSING OF METALLIC WORK PIECES

[75] Inventor: Jan Zeleny, Augsburg, Fed. Rep. of Germany

[73] Assignee: Kleindienst GmbH, Augsburg, Fed. Rep. of Germany

[21] Appl. No.: 2,706

[22] PCT Filed: Feb. 27, 1986

[86] PCT No.: PCT/EP86/00102

§ 371 Date: Nov. 5, 1986

§ 102(e) Date: Nov. 5, 1986

[87] PCT Pub. No.: WO86/05422

PCT Pub. Date: Sep. 25, 1986

[30] Foreign Application Priority Data

Mar. 13, 1985 [DE] Fed. Rep. of Germany ..... 3509006

[51] Int. Cl.[4] ..... B65G 59/04

[52] U.S. Cl. ..... 414/121; 271/18.1; 414/122; 414/281

[58] Field of Search ..... 414/37, 112, 117, 121, 414/122, 273, 281, 282, 283; 271/18.1

[56] References Cited

U.S. PATENT DOCUMENTS 4,024,963 5/1977 Hautau ..... 414/121 X

FOREIGN PATENT DOCUMENTS 66182 12/1982 European Pat. Off. ..... 414/664

2256068 12/1973 Fed. Rep. of Germany .

2534819 2/1977 Fed. Rep. of Germany .

58-31822 2/1983 Japan ..... 414/121

1070100 1/1984 U.S.S.R. ..... 414/122

OTHER PUBLICATIONS

Werkstatt und Betrieb; 117 (1984) 10; Oct. 1984; M. Benzinger, "Flexible Automatisierte Fertigung ebener . . . "; pp. 641–646.

Tooling & Production; Jan. 1985; Flexible Fabricating Punches Up Productivity"; pp. 77–79.

*Primary Examiner*—Leslie J. Paperner

*Attorney, Agent, or Firm*—Herbert Dubno

[57] ABSTRACT

The invention concerns itself with the automatic processing of metal sheets. These are placed onto pallets (6) in form of stacks (7) and are fed to a pallet storage (4) in form of a high multi-tier shelf coordinated to each production machine (1). Between the pallet storage (4) and the production machine is provided a transport device (9) movable vertically along the pallet storage, which accepts a pallet (6) with a sheet metal stack (7) or delivers an empty pallet (6). The transport device (9) contains a single-sheet feeder (11), for example in the shape of suction heads (20) which lift off the topmost sheet, place it on a sheet support table (23) and from there feed it to the production machine. So as to facilitate the disengagements of the sheets from one another, magnets (18) are so arranged that under their influence they spread the forward positions of the sheets from one another.

11 Claims, 2 Drawing Sheets

MANUFACTURING SYSTEM FOR THE AUTOMATIC PROCESSING OF METALLIC WORK PIECES

FIELD OF THE INVENTION

The invention concerns a manufacturing system for the automatic processing of metallic work pieces carried by pallets in which a pallet storage is provided between at least one production machine and a guide path for the transport of the pallets, from which (pallet storage) is effected the feeding of the production machine.

BACKGROUND AND SUMMARY OF THE INVENTION

An arrangement of this kind is already known from VDI-Z 121 (1979) No. 3, pp. 83–95, particularly illustration 26. With respect to automation of production processes, arrangements of this type start with the fact that buffer zones must be provided between the transport means for the pallets and the production machines so as to be able to store pallets temporarily during unavailability of one or the other equipment.

The invention begins from this state of the art and has as its objective to fashion a manufacturing system in such manner that metal sheets can be fed to production machines automatically, without the need for essential modification of the latter.

The essence of the invention resides in the fact that a pallet storage for pallets loaded with stacks of sheet metal realized as a high (multi-tier) shelf is provided at a distance ahead of the feed station of the production machine, and that the intervening space is filled by a transport means which is guided along the pallet storage movably in the vertical and that the pallet storage is equipped with a pallet change arrangement as well as a single-part feeder for the automatic feeding of single sheets to the production machine.

High multi-tier shelves for the support of stacks of sheet metal carried by pallets are known. It is also known how to array transport means adjustable lengthwise and transversely as well as in elevation with such high multi-tier shelves. However, it is not known how to arry such tall multi-tier shelves, which in the case of the invention exhibit more of a columnar shape at a given distance ahead of a production machine, in order to take the pallets and/or stacks of sheet metal on the side away from the production machine and to place them into the high multi-tier shelf, while on the side facing the production machine the loaded pallets are removed from any tier of the high multi-tier shelf by the action of the transport means in the sense of the invention and brought into a position where the automatic feeding of single sheets to the production machine can take place.

A distinct advantage of the invention lies in the fact that the production machine need not be extensively modified in order to accomodate the production system.

In accordance with the invention, there is provided a single-item feed device having suction heads movably guided horizontally and vertically which acts upon the sheet metal surface. The feed device has the capability of always lifting the topmost sheet in the stack and feeding it to the production machine.

According to the invention, an important aspect lies in use of a transport means exhibiting on the side away from the production machine a support table for the metal sheets with elements which induce sliding, and whose support plane, in the transfer position of the transport means lies above the intake plane of the production machine. For the purpose of connection to said intake plane, the support table is capable of changing position. Thereto it is recommended that the support table for the sheet metal on the transport means is pivotable about an axis disposed above the intake plane, and is equipped with an oscillating drive. Thus the capability is attained of moving the metal sheet topmost at the moment along the sheet metal support table forward over such distance that upon slewing of said table a sliding movement of the metal sheet into the production machine can occur automatically because of gravity.

The particular problem of the invention resides in the capability to separate the several metal sheets of the sheet metal stack from one another. It is a fact that normally metal sheets are provided on their surfaces with a layer of grease, which increases the adhesion between the individual metal sheets significantly. In a stack of metal sheets thus treated, it would in principle be impossible to separate the topmost sheet from the one below it by a lifting motion alone.

The invention discloses therefore, in the framework of the overall principle of the invention, the arrangement of magnets on both sides close the stack near the corners facing the production machine. Magnet arrangement is such that positive and negative poles are held in a magnet holder at a distance one above the other and are turned towards the stack.

Such magnets can be realized as permanent magnets, or as switchable electro-magnets. If permanent magnets are used they must be adjustable from an inactive into an active position, particularly by pivoting. Switchable electro-magnets can remain in their position provided that the control permits activation of the magnets only during feed of single sheets.

The effect of the magnets emplaced and constructed in accordance with the invention lies in the fact that upon their excitation, steel sheets lying on top of one another tend to spread apart due to the magnetic flux. The magnetic excitation of the steel sheets therefore loosens the adhesive bond of the steel sheets in the area facing the production machine. As a consequence the steel sheets shift relative to one another in the direction of feed. Thus the topmost sheet moves furthest in rearward direction from the stack originally formed.

The invention utilizes this effect in such manner that the suction heads acting upon the sheet metal surface effect a downwards directed motion upon the rear area of the sheet metal before the forward motion for feeding the the metal sheet into the production machine takes place.

Thus this measure has the effect that the metal sheet lying topmost at any time is pressed downwards on its rearward side, while the forward side of the sheet is lifted due to the spreading action of the magnets. In this position, the topmost sheet can now be transferred without effort to the sheet support table of the transport means. As soon as the forward area of the topmost sheet lies upon said sheet support table, there is no longer any problem in advancing the sheet in the direction toward the production machine, and to then transfer it to the intake of said machine.

According to the invention, the suction heads are articulated. In order to accomplish this operation there is provide articulatedly journalled suction disks on the suction heads.

There are cases where cleaned or non-magnetizable sheets are stacked, so that the adhesion between individual sheets is reduced. Under such conditions the invention proposes that the suction heads acting upon the sheet surface be equipped with a vertically acting vibration drive. It has in fact become evident that under this repeated vertical impulse loading there takes place a loosening of the sheets from one another, i.e. a reduction of adhesion. One can thus control the motion components of such suction heads in series, in that repeated pressure and suction impulse is first imparted to the sheet topmost in the stack, and that then the sheet is moved in direction towards the production machine in raised position.

So as to prevent that two or more sheets are fed to the production machine together, the invention provides for a measuring means for sheet thickness in the transition area between the transport means and the production machine, where it is particularly recommended to implement said measuring means in form of an ultrasonic measuring instrument. Such a measuring instrument has the property of determining the difference in thickness of sheets, and even of measuring air spaces between layers of sheet metal.

BRIEF DESCRIPTION OF THE DRAWING

Details of the invention are shown in the drawing schematically and by way of example. The drawings include.

DETAILED DESCRIPTION

Figure 1:
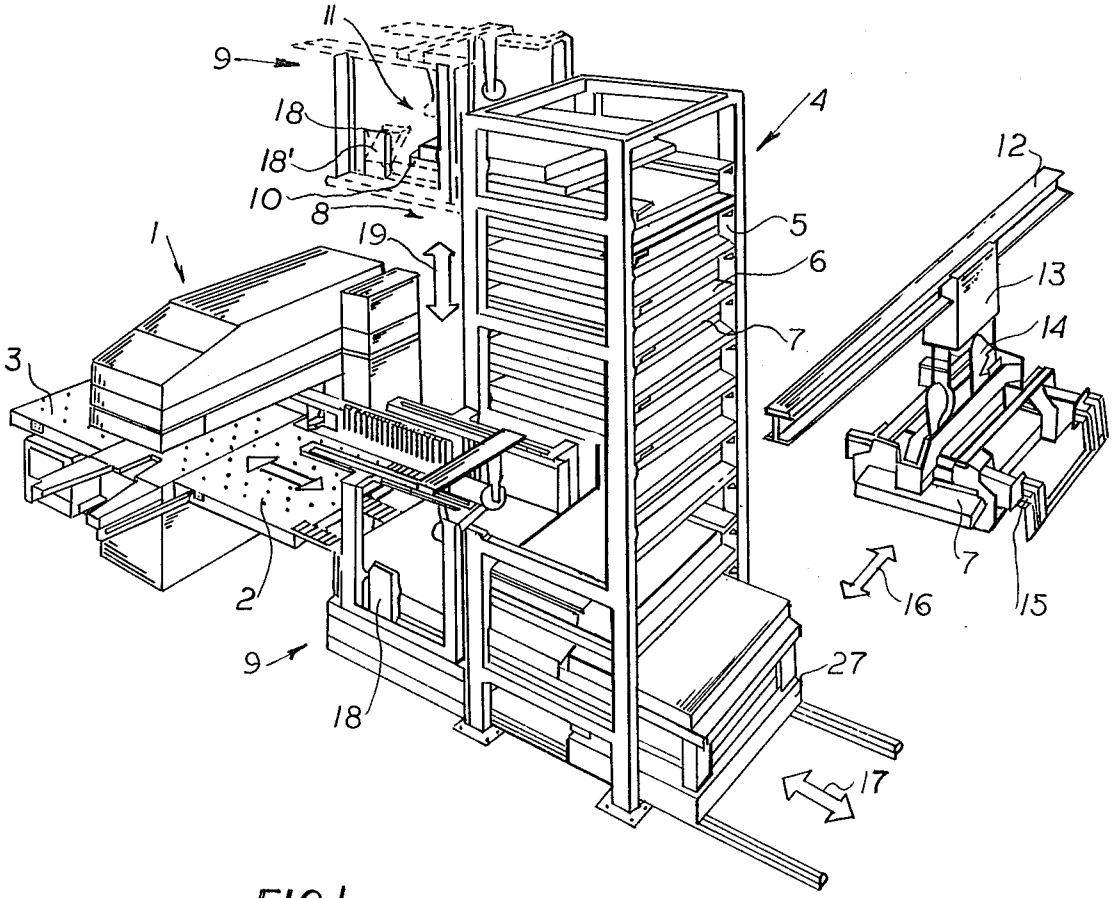
FIG. 1: a perspective view of a processing system.

FIG. 1 shows symbolically a production machine 1, which may be by way of example a punch press, shear, press brake or similar machine for processing sheet metal. An intake plane 2 for the workpieces to be processed is associated with production machine 1. The example illustrates a table with sliding elements upon which the work piece, in most cases a metal sheet, can be moved ahead with little friction. An exit plane 3 is provided behind production machine 1. This plane can also be placed to the side of said production machine 1.

In the space ahead of production machine 1 there is a pallet storage 4 in form of a high multi-tier shelf, into whose compartments 5 the pallets 6 with sheet metal stacks 7 arrayed thereon are introduced in random manner. The space 8 between said pallet storage 4 and the production machine 1 is occupied by a transport means 9, which is movable upwards in lift direction 19 along pallet storage 4. This affords the capability that the transport means 9 can remove a pallet 6 from any compartment 5 of the pallet storage 4, or introduce it thereinto.

For this purpose the transport means 9 exhibits a pallet exchange means 10 which is shown only symbolically, since it is already known in conjunction with high muti-tier shelves, and a single-feed means 11 which will be described in detail later.

The purpose of this arrangement according to the invention is that the transport means 9 should be capable of being moved forward through a certain distance in lift direction 19 to receive a pallet 6 from pallet storage 4, or to feed one to the latter. Basis for this is that the pallet exchange means 10 is a component part of transport means 9. It conforms to the principle of symmetry that such exchange means can also be arranged on pallet storage 4. Since they are known in principle, further details are not here presented.

On the side of the pallet storage 4 away from the production machine 1 there is a guide 12 for one or more slides 13, wherefrom depend, via lifting means 14, carrier 15 for sheet metal stack 7 or (not shown) pallet exchange means or similar, which in turn assure that sheet metal stacks 7 can be moved along guides 12, 14. It is provided, by way of example, that empty pallets 6 are moved along transport means 17 by instrumentality of vehicle 27 all the way to a loading station, where they are loaded with sheet metal stacks 7 in accordance with arrangement 12–15. In addition, vehicle 27 can be equipped with a lifting table in order to enter the pallets 6 into the several compartments 5.

A spreading mens 18 in front of magnets is shown symbolically in FIG. 1. When actuated, these magnets 18 have the task of separating the sheets of sheet metal stack 7 from one another. For this purpose, the single magnet 18 exhibits positive and negative poles arranged one over the other and at a distance (from one another on the side facing stack 7. Thereby, a magnetic flux is to be caused between the poles of magnet 8 which will lead to a spreading of the sheets. In the case of permanent magnets, they must be arranged movably. For example, they can be pivoted along a horizontal axis, which extends parallel to the transport direction 17, in order to arrive in an ineffective position; this is depicted as magnet 18. When the sheets from stack 7 are to be fed singly, then magnet 18 must indeed be moved into the position according to FIG. 1. The same effect can be achieved by movement of the magnets 18, perhaps in vertical direction. In addition it is possible to provide switchable electro-magnets, and to cause the action by means of switching them on and off.

Figure 2:
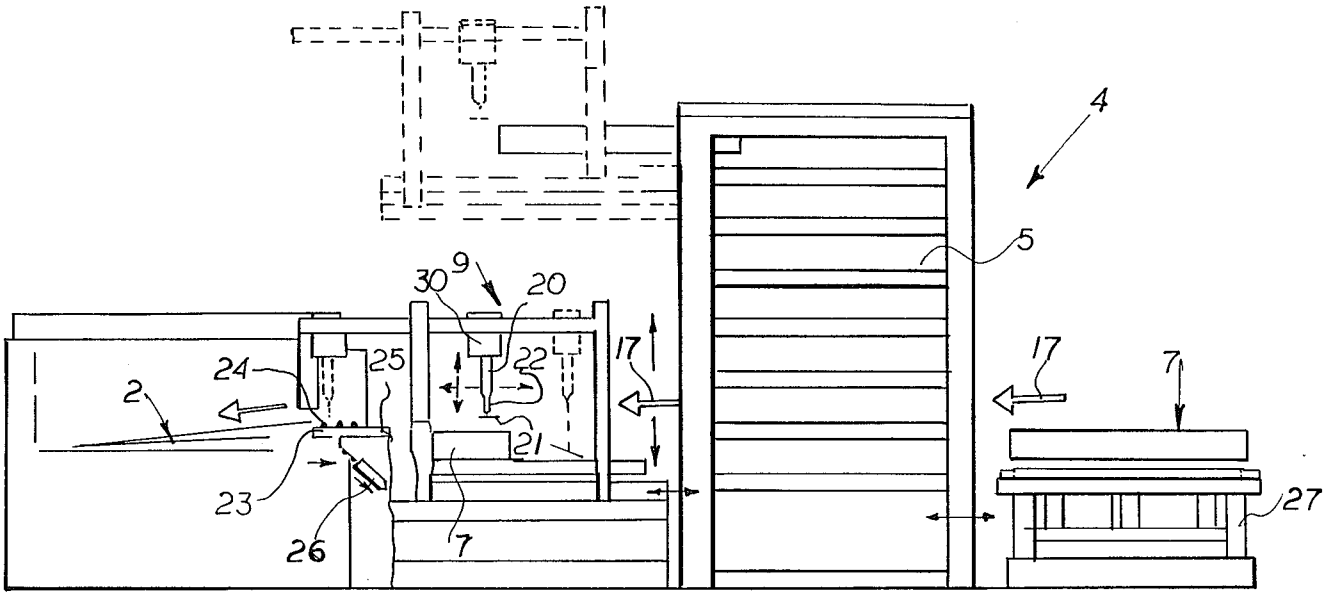
FIG. 2: a side view of the processing system according to FIG. 1.

As FIG. 2 shows, the several suction heads 20 are coordinated to movements in different directions. The example shows suction disks 21 journaled pivotably on suction head 20 via link 22, which have the task of following the skew position of every topmost sheet of the sheet metal stack 7 and still produce adhesive effect to this sheet. In FIG. 2, in dot-and-dash lines to the right and left side of the transport means 9, positions with different location of suction disk 21 are shown.

On the side of transport means 9 facing production machine 1, there is a sheet support table 23 which exhibits elements 24 on its surface which induce sliding. This sheet support table 23 is pivotably journaled about link 25 which is positioned above the intake plane 2 of the production machine 1. This table can be moved about the link 25 by means of pivoting drive 26.

The single-feeding of the sheets of the sheet stack 7 is effected in the following manner:

The position of the of the sheet metal stack 7 shown in FIG. 2 is based on the proposition that the edges of the individual sheets lie aligned upon one another when a pallet 8 when the sheet metal stack 7 is taken over from the pallet storage 4 by transport means 9. If for instance the sheets are greased on their surfaces, there is in principle no chance of lifting the topmost sheet off stack 7 and feeding it to the production machine 1.

In order to effect the fanning out of the individual sheets of the sheet metal stack 7, the magnets 18 or other similarly acting spreading means are actuated according to FIG. 1. Thereupon the sheets lying in the space facing production machine 1 are caused to distance themselves from one another. From this results a relative sliding of the sheets so that the topmost sheet of sheet metal stack 7 protrudes furthest towards the rear from the rearward end of the stack.

The invention utilizes the foregoing thrugh a suction head 20 shown in the position furthest to the right in dot-and-dash lines which exerts with its suction disk 21 a downwards-directed lift. Due to the fanned-out position of the sheets there is effected a skewed positioning of the topmost sheet. Therefore this topmost sheet arrives in a position with its leading edge raised with respect to sheet support table 23, so that a horizontal lifting movement of the suction head 20 has the effect of sliding the topmost sheet with its leading edge onto sheet support table 23. As soon as the overweight of the sheet is on the machine side, the pivot drive 26 is actuated and the sheet support table 23 is lowered into the position shown in dot-and dash lines, namely pivoting about line 25. Now the sheet lying thereon can arrive in the intake plane 2 of production machine 1 due to its own force of gravity.

If however cleaned or non-magnetizable sheets are stacked up, then it will be advisable to equip the individual suction heads 20 with vibrating drives 30 which will exert vrtical power pulses upon the surface of the topmost sheet. By means of these power impulses it is also possible to distance the sheets from one another and then to advance them to the production machine.

In order to avoid the feeding of sheets lying on top of one another, it is recommended to provide, in the area of sheet support table 23, on the side, measuring instruments for the determination of sheet thickness, which can, for example, be realized as ultra-sonic measuring instruments. By means of these measurements, the movements of the suction heads 20 can be corrected.

I claim:

1. Manufacturing system for the automatic processing of metallic workpieces comprising:

at least one production machine;

a plurality of pallets for carrying said workpieces, said workpieces comprising single metal sheets;

an intake station for accepting said single metal sheets for processing in said production machine;

a pallet storage from which the production machine is fed with said metal sheets, said pallet storage having a plurality of shelves holding said pallets loaded each with a stack of said single metal sheets, said pallet storage being provided at a distance upstream from said intake station;

a transport means for moving said pallets between said pallet storage and said production machine occupying a gap therebetween, said transport means being movable vertically along said pallet storage and comprising a pallet change means for rearranging andd removing pallets from said shelves, and a single-sheet feeder means for the automatic feeding of single sheets into said production machine, said pallet change means having a first side for receiving pallets loaded with metal sheets and a side opposite therefrom through which said metal sheets are delivered to said intake station by operation of said feeder;

2. Manufacturing system according to claim 1, characterized by the fact that the single-sheet feeder comprises suction heads movably guided horizontally and vertically acting upon a surface of the metal sheet.

3. Manufacturing system according to claim 1, characterized by the fact that the transport means comprises, on a side facing the production machine, a sheet support table with slide-inducing elements, whose support plane, in a transfer position of the transport means, lies above a sheet receiving plane of the intake station of the production machine, and said table being capable of changing position for the purpose of connection to said plane of the intake station.

4. Manufacturin system according to claim 3, characterized by the fact that the sheet support table on said transport means is journaled pivotably about an axis arrayed above the plane of the intake table and is equipped with a pivot drive.

5. Manufacturing system according to claim 1 characterized by the fact that the single-sheet feeder comprises one or more magnets arranged on both sides of said feeder next to a stack of said metal sheets near corners facing the production machine and in such manner that positive and negative poles of said magnets are held at a distance on top of one another in a magnet holder, and face the stack.

6. Manufacturing system according to claim 5, characterized by the fact that the magnets are permanent magnets and are displaceable from an inactive to an active position.

7. Manufacturing system according to claim 2, characterized by the fact that the suction heads acting upon the surface of the metal sheet exert a downwards directed motion upon a rearward area of the metal sheet, before an advance motion for feeding of the sheet into the production machine takes place.

8. Manufacturing system according to claim 7, characterized by the fact that the suction heads are connected to suction disks pivotably journaled on said heads in an articulated manner.

9. Manufacturing system according to claim 2, characterized by the fact that the suction heads acting upon the surface of the metal sheet are equipped with a vertically acting vibration drive.

10. Manufacturing system according to claim 1 characterized by further comprising a measuring means for measuring a thickness of the sheet in a transition area between the transport means and the production machine.

11. Manufacturing system according to claim 6, characterized by the fact that the magnets are displaceable by pivoting.

* * * * *